US008535169B2

(12) United States Patent
Molinari

(10) Patent No.: US 8,535,169 B2
(45) Date of Patent: Sep. 17, 2013

(54) GOLF BALL WITH INDICIA TO INDICATE IMPARTED SHEAR FORCE

(75) Inventor: Arthur Molinari, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 658 days.

(21) Appl. No.: 12/723,004

(22) Filed: Mar. 12, 2010

(65) Prior Publication Data

US 2011/0224015 A1 Sep. 15, 2011

(51) Int. Cl.
*A63B 57/00* (2006.01)

(52) U.S. Cl.
USPC ..... 473/200; 473/198; 473/199; 473/354; 473/374

(58) Field of Classification Search
USPC ..... 473/353–355, 200, 370, 280, 409, 473/371–374, 376, 377, 594, 198
See application file for complete search history.

(56) References Cited

U.S. PATENT DOCUMENTS

| | | | | |
|---|---|---|---|---|
| 2,884,254 | A * | 4/1959 | Miner | 473/200 |
| 3,517,933 | A * | 6/1970 | Malkin | 473/125 |
| 3,655,197 | A * | 4/1972 | Milbaum | 273/146 |
| 4,006,908 | A * | 2/1977 | Minami | 473/200 |
| 4,546,975 | A * | 10/1985 | Nims | 473/447 |
| 4,603,861 | A * | 8/1986 | Arnott | 473/125 |
| 4,664,387 | A * | 5/1987 | Tardiff | 473/200 |
| 5,067,719 | A * | 11/1991 | Mook | 473/200 |
| 5,072,938 | A * | 12/1991 | Shin | 473/613 |
| 5,827,133 | A | 10/1998 | Chang | |
| 5,984,805 | A | 11/1999 | Maruko | |
| 6,217,464 | B1 * | 4/2001 | Chang | 473/378 |
| 6,244,971 | B1 * | 6/2001 | Mihran | 473/200 |
| 6,846,249 | B2 * | 1/2005 | Lacroix et al. | 473/374 |
| 7,232,382 | B2 * | 6/2007 | Kennedy et al. | 473/354 |
| 7,691,005 | B2 * | 4/2010 | Mitsuba | 473/280 |
| 7,722,483 | B2 * | 5/2010 | Morgan et al. | 473/378 |
| 8,272,977 | B2 * | 9/2012 | Oldknow | 473/376 |
| 2004/0176184 | A1 * | 9/2004 | Morgan et al. | 473/371 |
| 2004/0176185 | A1 * | 9/2004 | Morgan et al. | 473/371 |
| 2008/0045358 | A1 * | 2/2008 | VanDelden | 473/376 |
| 2009/0075744 | A1 * | 3/2009 | Tuxen | 473/200 |

FOREIGN PATENT DOCUMENTS

| | | | |
|---|---|---|---|
| EP | 2364755 | | 11/2012 |
| WO | WO9409863 | A1 * | 5/1994 |

OTHER PUBLICATIONS

Extended European Search Report dated Jul. 20, 2011 in European Application No. 11157567.
Notification of Grant of Patent Right for Utiltiy Model for Chinese Utility Model Patent Application No. 201120066998.7, issued on Aug. 30, 2011.
Communication under Rule 71(3) EPC for European Patent Application No. EP11157567.6, mailed on May 30, 2012.

* cited by examiner

*Primary Examiner* — Gene Kim
*Assistant Examiner* — Matthew B Stanczak
(74) *Attorney, Agent, or Firm* — Plumsea Law Group, LLC

(57) ABSTRACT

A golf ball includes an inner layer, an outer layer, and a cavity therebetween. A fluid, such as a viscous damping fluid, is placed in the cavity. When the ball is struck, the inner and outer layers rotate independently of one another. Indicia are provided on the inner and outer layers. An examination of the relative position of the indicia before the ball is struck and after the ball is struck can yield data that indicate the shear force of the stroke.

7 Claims, 8 Drawing Sheets

GOLF BALL WITH INDICIA TO INDICATE IMPARTED SHEAR FORCE

FIELD

The present disclosure relates generally to a golf ball incorporating indicia. More specifically, the present disclosure relates to a golf ball that includes indicia that can be used to calculate the shear force imparted to the ball upon impact with a club.

BACKGROUND

There are various systems that exist that allow a person to measure the shear force imparted to a golf ball upon impact with a golf club. Most of these systems determine club head speed, which is then used to estimate or calculate shear force.

Conventionally, club head speed can be measured with various equipment or methods. The club head speed can be measured directly through a sensor on the club or a camera-based system. Alternatively, the club head speed could be measured indirectly through the use of an impact mark on the club or ball. Other conventional systems can be used to otherwise calculate club head speed. However, each of these systems requires the use of an external sensor or other piece of equipment.

The knowledge of the shear force generated by a particular stroke can be useful for many things. It can be used, for example, to select a particular ball. Alternatively, it can be used to change a golfer's swing mechanics to change the shear force generated by his or her swing profile.

In the conventional systems, while there are conventionally known structures and methods available to make the calculation, such systems are not typically used by an ordinary golfer. An ordinary golfer may be dissuaded from using the systems because they are expensive or complicated.

Therefore, it is desirable to consider systems for measuring shear force that are relatively inexpensive and that can be used either in a professional context or as a typical golfer.

SUMMARY

In one aspect, a golf ball includes an inner layer, an outer layer, and a cavity between the inner layer and the outer layer. A first indicia is on the inner layer. The outer layer is spaced from the inner layer and is capable of rotating independently of the inner layer. A fluid is in the cavity. Second and third indicia can also be included. The second indicia can be on the outer layer and the third indicia can be on one of the inner layer and the outer layer.

In another aspect, a method of determining a shear force imparted to a golf ball is disclosed. A first indicia is provided on an inner layer of the ball. A second indicia is provided on an outer layer of the ball. A fluid is provided in a cavity between the inner layer and the outer layer. A first relative position of the first indicia and the second indicia is examined at a first specified time. A second relative position of the first indicia and the second indicia can be examined at a second specified time and the first and second relative positions can be compared.

In another aspect, a method of determining a shear force imparted to a golf ball is disclosed. An inner layer is provided and a sensor is positioned in the inner layer. An outer layer is spaced from the inner layer and is capable of rotating independently from the inner layer. The sensor may be capable of sensing the relative movement of the outer layer and the inner layer. The sensor data can then be acquired. A sensor trigger can be embedded in the outer layer.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The present embodiments relate to a golf ball structure and method for determining a shear force in a golf swing. Any of the golf ball structures can be used in any of the methods and any of the methods can be used with any of the balls. The ball embodiments disclosed may also be used to calculate other aspects of the swing mechanics.

Figure 1:
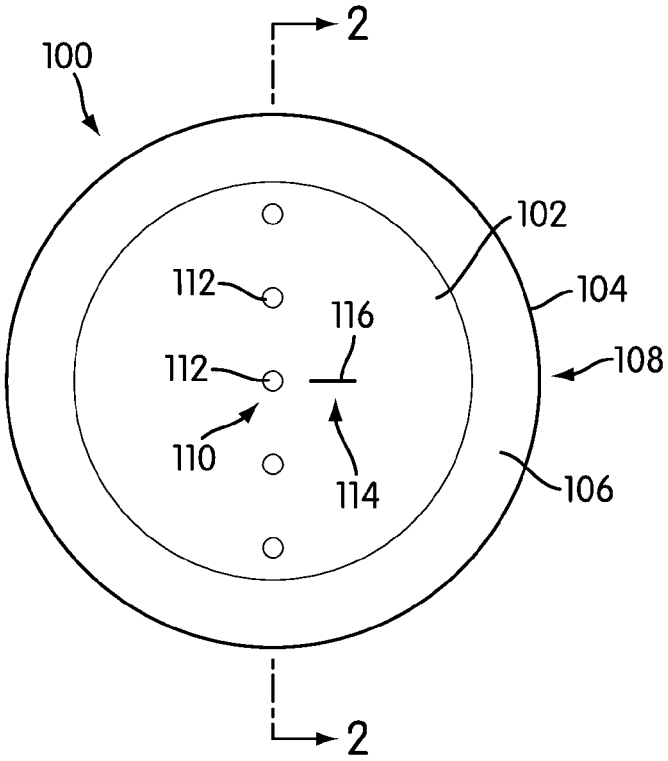
FIG. 1 is a front view of a first embodiment of a golf ball.
Figure 2:
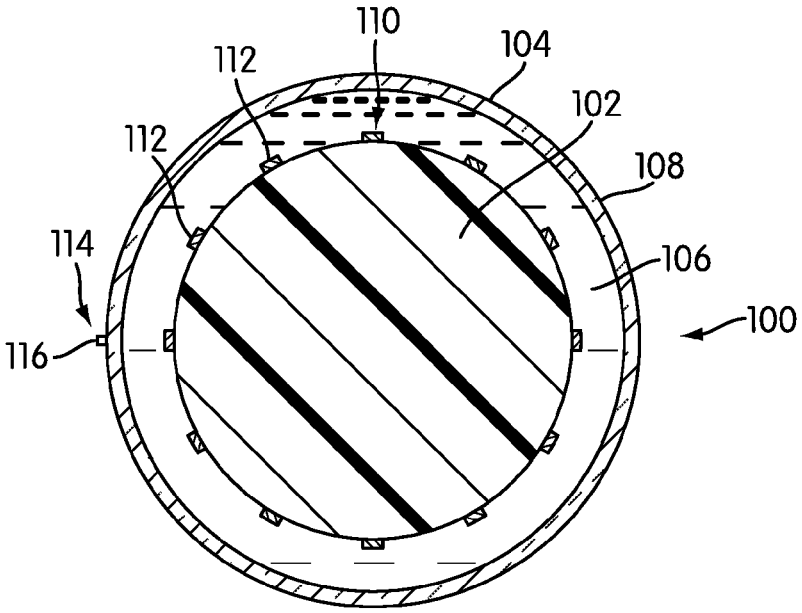
FIG. 2 is a cross section of the embodiment of FIG. 1 taken along line 2-2 of FIG. 1.

FIGS. 1 and 2 show a first embodiment of a golf ball 100. Golf ball 100 includes an inner layer 102 and an outer layer 104. Inner layer 102 and outer layer 104 are spaced from one another, forming cavity 106. A fluid is present in cavity 106. Inner layer 102 and outer layer 104 may be capable of rotating independently of one another.

The fluid in cavity 106 can be a liquid or a gas. In a simplified form, the gas can be the standard composition of air. However, if air or another gas is used, it may be desirable to insert the gas under pressure in order to keep inner layer 102 and outer layer 104 spaced from one another. Alternatively, the fluid can be a liquid. The liquid can be a high viscosity liquid that damps the relative rotation of inner layer 102 and outer layer 104.

Inner layer 102 can include a core. The core can be any of a variety of cores commonly used in golf balls. For example, the core could be liquid filled or solid filled. The solid may be rubber, resin, or any other suitable material. The core may also include various types of weights. The core may also include a wound cover. A person having ordinary skill in the art can select a core that produces the technical and flight characteristics that are desirable. An optional mantle layer is not specifically shown in the figures, but may surround and may be positioned outward of the core. Inner layer 102 is shown in FIGS. 1 and 2 as being the outer surface of the core, but may instead be defined by an outer surface of the optional mantle layer or another layer outward of the core.

In a commercial version, the outer layer, and in particular, outer surface 108 of outer layer 104, is configured to be struck by a golf club. Accordingly, outer layer 104 may include various dimples, frets or lands, projections, printing, or any other features that a designer thinks would be desirable in affecting the flight path of the ball 100. Outer layer 104 may be designed to be scuff resistant. In the embodiment of FIGS. 1 and 2, outer layer 104 is translucent. It may be desirable for outer layer 104 to be transparent or at least translucent.

The drawings illustrate layers having a variety of thicknesses. These thicknesses should not be considered to be the only possible thicknesses for the layers. The desirable thicknesses for the various layers depends on the materials a designer wishes to use and the qualities the designer wishes to provide by the various layers. A person having ordinary skill in the art can modify the present embodiments to provide for a ball having layers of appropriate thicknesses.

First indicia 110 is applied on inner layer 102. First indicia 110 includes a plurality of circles or dots 112. Second indicia 114 comprises a line 116 applied on outer layer 104. The application of first indicia 110 to inner layer 102 and application of second indicia 114 to outer layer 104 can be performed by any technical means that is available or desirable based on the materials used for first indicia 110, second indicia 114, inner layer 102, and outer layer 104. In some cases, the indicia can be applied to the respective layer by printing it on the top of the layer, as shown in FIGS. 1 and 2. Alternatively, the indicia may be embossed on the respective layer and may be even with the outer surface of the respective layer.

Figure 3:
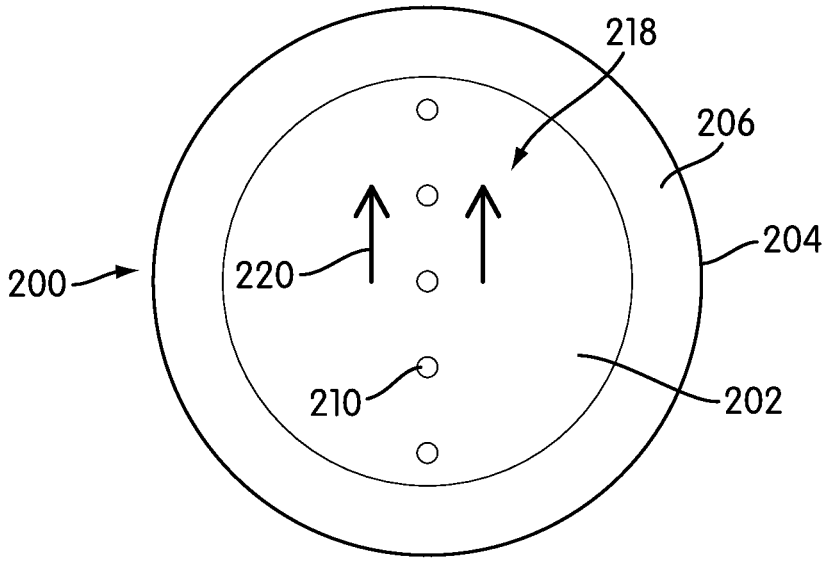
FIG. 3 is a top view showing directional indicia.

FIG. 3 shows a top view of an alternative embodiment of a golf ball 200. Golf ball 200 includes an inner layer 202 that has the same characteristics as inner layer 102 and an outer layer 204 that has the same characteristics as outer layer 104. Inner layer 202 and outer layer 204 are spaced from one another, forming cavity 206 that has the same characteristics as cavity 106, including being filled with a similar fluid. Inner layer 202 and outer layer 204 may be capable of rotating independently of one another.

First indicia 210 is applied on inner layer 202 and has the same basic characteristics as first indicia 110. First indicia 210 includes a plurality of circles or dots 212. Ball 200 may include second indicia, but this is not shown in FIG. 3. Ball 200 also may include third indicia 218. Third indicia 218 may include two arrows 220. Third indicia 218 may be positioned to assist a user in positioning ball 200 in an appropriate or desired orientation of ball 200 when ball 200 is to be struck by a golf club when used in the method disclosed in greater detail below. Third indicia 218 is shown only in the embodiment of FIG. 3, but it can easily be added to any of the embodiments illustrated in other figures. Third indicia 218 can be imprinted or applied on either inner layer 202 or outer layer 204, whichever is deemed more desirable by the designer.

Figure 4:
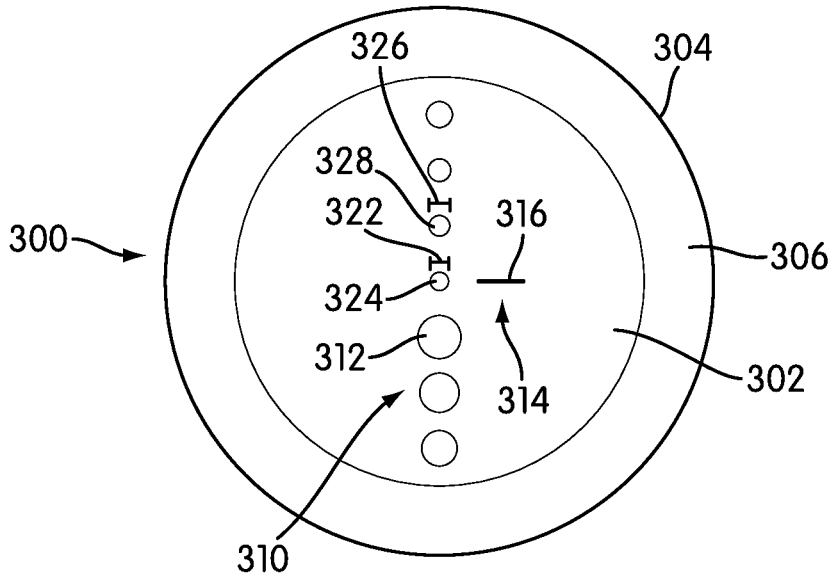
FIG. 4 is a front view of another embodiment of a golf ball.

FIG. 4 shows a side view of an alternative embodiment of a golf ball 300. Golf ball 300 includes an inner layer 302 that has the same characteristics as inner layer 102 and an outer layer 304 that has the same characteristics as outer layer 104. Inner layer 302 and outer layer 304 are spaced from one another, forming cavity 306 that has the same characteristics as cavity 106, including being filled with a similar fluid. Inner layer 302 and outer layer 304 may be capable of rotating independently of one another.

First indicia 310 is applied on inner layer 302 and has the same basic characteristics as first indicia 110. First indicia 310 includes a plurality of circles or dots 312. The circles or dots 312 differ from the circles or dots 112 of the first indicia 110 in that they have gradually increasing diameters. For example, diameter 322 of first exemplary dot 324 is smaller than diameter 326 of adjacent second exemplary dot 328. Second indicia 314 is applied to outer layer 304 and has the same basic characteristics as second indicia 114. Second indicia 314 may comprise a line 316.

The use of a series of differently sized dots as first indicia 310 may provide a mechanism to designate or determine the initial or first relative position of first indicia 310 and second indicia 314. For example, a user may examine ball 300 to determine the relative position of first indicia 310 and second indicia 314. The user may rotate inner layer 302 relative to outer layer 304 until the smallest dot 324 is generally aligned or positioned adjacent line 316 in a particular relative position. The user may cause this rotation via rolling or shaking or any other available mechanism or method as may be desirably used. For example, in this or any of the other embodiments, a magnetic element could be embedded or positioned in the inner layer and a magnet could be used to move the inner layer relative to the outer layer until first indicia 310 is positioned in alignment with second indicia 314. This alignment of the first indicia 310 and second indicia 314 may be useful when one of the methods disclosed below is used.

Figure 5:
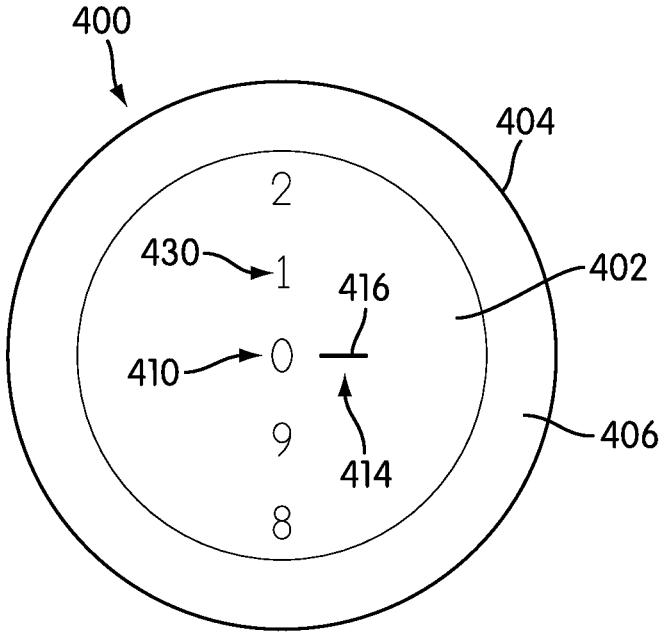
FIG. 5 is a front view of another embodiment of a golf ball.

FIG. 5 shows a side view of an alternative embodiment of a golf ball 400. Golf ball 400 includes an inner layer 402 that has the same characteristics as inner layer 102 and an outer layer 404 that has the same characteristics as outer layer 104. Inner layer 402 and outer layer 404 are spaced from one another, forming cavity 406 that has the same characteristics as cavity 106, including being filled with a similar fluid. Inner layer 402 and outer layer 404 may be capable of rotating independently of one another.

First indicia 410 is applied on inner layer 402 and has the same basic characteristics as first indicia 110. First indicia 410 includes a plurality of numbers 430. The numbers 430 can be a series of gradually increasing numbers, for example increasing from 0 to 9 as shown in FIG. 5. Second indicia 414 is applied to outer layer 404 and has the same basic characteristics as second indicia 114. Second indicia 414 may comprise a line 416.

The use of a series of gradually increasing numbers as first indicia 410 may provide a mechanism to designate or determine the initial or first relative position of first indicia 410 and second indicia 414. For example, a user may examine ball 400 to determine the relative position of first indicia 410 and second indicia 414. The user may rotate inner layer 402 relative to outer layer 404 until a desired number 430, such as the number 0 as shown, is generally aligned or positioned adjacent line 416 in a particular relative position. The user may cause this rotation via rolling or shaking or any other available mechanism or method as may be desirably used. This alignment of the first indicia 410 and second indicia 414 may be useful when one of the methods disclosed below is used.

Figure 6:
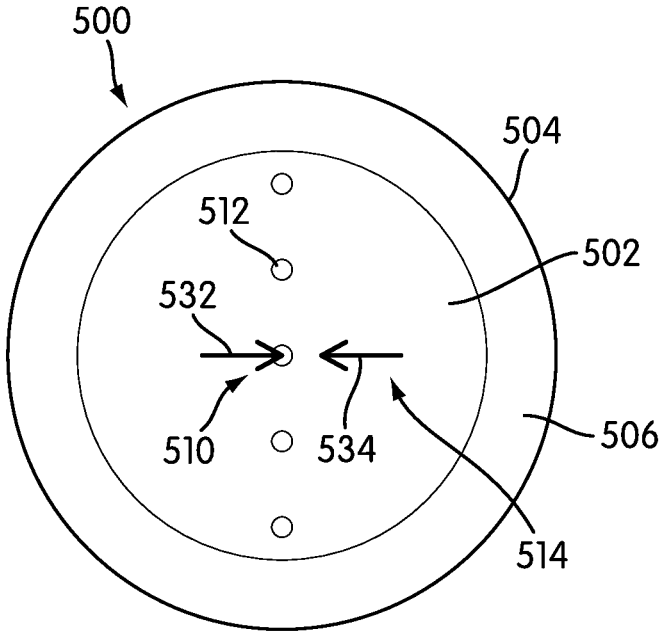
FIG. 6 is a front view of another embodiment of a golf ball.

FIG. 6 shows a side view of an alternative embodiment of a golf ball 500. Golf ball 500 includes an inner layer 502 that has the same characteristics as inner layer 102 and an outer layer 504 that has the same characteristics as outer layer 104. Inner layer 502 and outer layer 504 are spaced from one another, forming cavity 506 that has the same characteristics as cavity 106, including being filled with a similar fluid. Inner layer 502 and outer layer 504 may be capable of rotating independently of one another.

First indicia 510 is applied on inner layer 502 and has the same basic characteristics as first indicia 110. First indicia 510 includes a plurality of circles or dots 512. In addition to the inclusion of circles or dots 512, first indicia 510 may include an alignment aid, such as arrow 532. Second indicia 514 is applied on outer layer 504 and has the same basic characteristics as second indicia 114. Second indicia 514 may comprise arrow 534.

The use of two arrows, one arrow 532 as a part of first indicia 510 and one arrow 534 as a part of second indicia 514 may provide a mechanism to define the initial relative position of first indicia 510 and second indicia 514. For example, a user may examine ball 500 to determine the relative position of first indicia 510 and second indicia 514. The user may rotate inner layer 502 relative to outer layer 504 until first indicia arrow 532 is generally aligned or positioned adjacent second indicia arrow 534 in a particular relative position. The user may cause this rotation via rolling or shaking or any other available mechanism or method as may be desirably used. This alignment of the first indicia 510 and second indicia 514 may be useful when one of the methods disclosed below is used.

Figure 7:
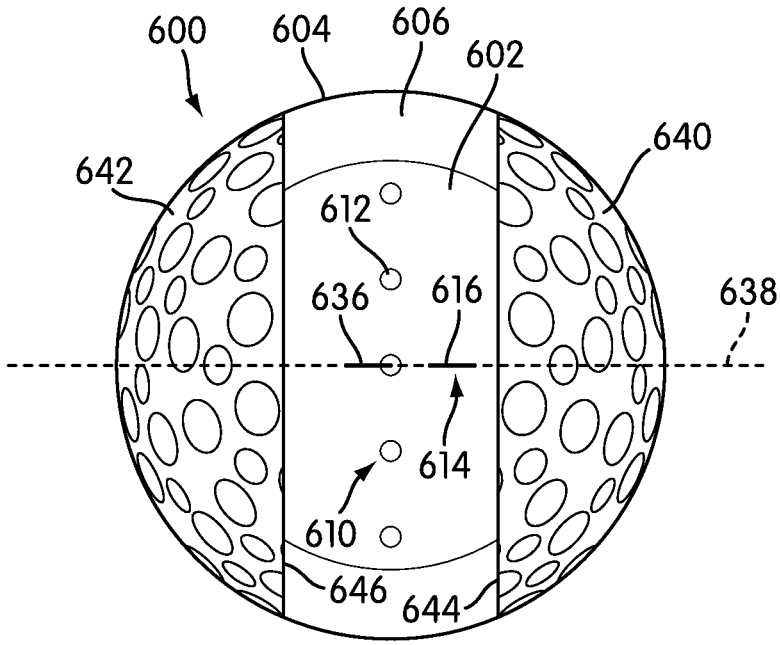
FIG. 7 is a front view of another embodiment of a golf ball showing a first embodiment of a guide.

FIG. 7 shows a side view of an alternative embodiment of a golf ball 600. Golf ball 600 includes an inner layer 602 that has the same characteristics as inner layer 102 and an outer layer 604 that has the same characteristics as outer layer 104. Inner layer 602 and outer layer 604 are spaced from one another, forming cavity 606 that has the same characteristics as cavity 106, including being filled with a similar fluid. Inner layer 602 and outer layer 604 may be capable of rotating independently of one another.

First indicia 610 is applied on inner layer 602 and has the same basic characteristics as first indicia 510. First indicia 610 includes a plurality of circles or dots 612. In addition to the inclusion of circles or dots 612, first indicia 610 may include an alignment aid, such as line 636. Second indicia 614 is applied on outer layer 604 and has the same basic characteristics as second indicia 514. Second indicia 614 may comprise line 616.

As shown in FIG. 7, it may be desirable to restrict the rotation of the inner layer 602 relative to outer layer 604 such that the rotation only occurs on a single axis of rotation, such as axis 638, and restrict movement along any other axis. Such a restriction can be enforced by the inclusion of a guide on ball 600. As shown in FIG. 7, the guide includes first guide section 640 and second guide section 642. First guide section 640 and second guide section 642 are each secured to inner layer 602 so that neither can rotate with respect to inner layer 602. First guide section 640 and second guide section 642 are shown in FIG. 7 as being similar in material and design to a standard golf ball. The guide sections 640, 642 could instead be of the same material as the rest of outer layer 604 but simply secured to inner layer 602. As a further alternative, first divider 644 could be inserted between first guide section 640 and outer layer 604 and second divider 646 could be inserted between second guide section 642 and outer layer 604. First divider 644 and second divider 646 could be used alone, allowing first guide section 640 and second guide section 642 to independently rotate around axis 638.

Figure 8:
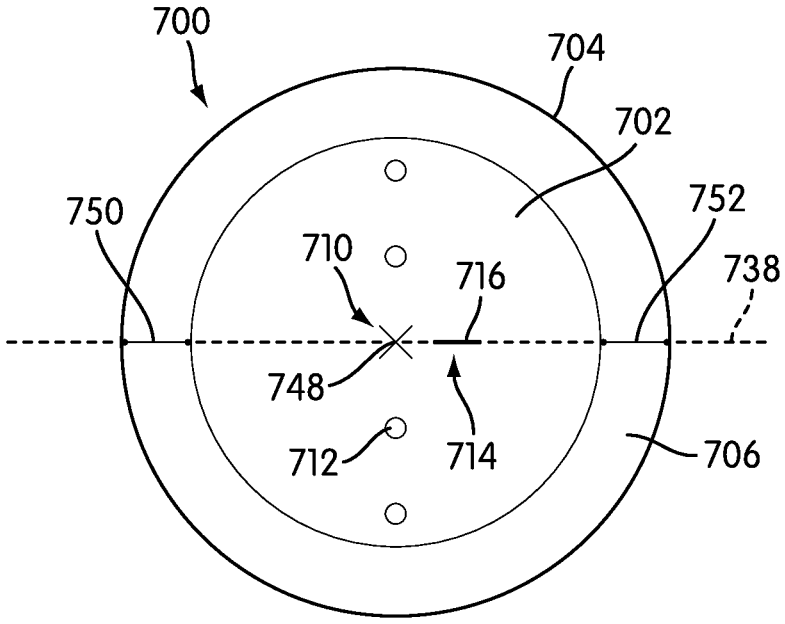
FIG. 8 is a front view of another embodiment of a golf ball showing an alternative embodiment of a guide.

FIG. 8 shows a side view of an alternative embodiment of a golf ball 700. Golf ball 700 includes an inner layer 702 that has the same characteristics as inner layer 102 and an outer layer 704 that has the same characteristics as outer layer 104. Inner layer 702 and outer layer 704 are spaced from one another, forming cavity 706 that has the same characteristics as cavity 106, including being filled with a similar fluid. Inner layer 702 and outer layer 704 may be capable of rotating independently of one another.

First indicia 710 is applied on inner layer 702 and has the same basic characteristics as first indicia 510. First indicia 710 includes a plurality of circles or dots 712. In addition to the inclusion of circles or dots 712, first indicia 710 may include an alignment aid, such as a special character 748, specifically shown as letter X. Second indicia 714 is applied on outer layer 704 and has the same basic characteristics as second indicia 514. Second indicia 714 may comprise line 716.

FIG. 8 shows another alternative embodiment of a guide. If it is desired to restrict movement or rotation of outer layer 704 relative to inner layer 702, a guide can be inserted along axis 738. First spindle 750 and second spindle 752 can be installed between inner layer 702 and outer layer 704 along axis 738. Each of first spindle 750 and second spindle 752 may be of as many pieces as may be desirable so that inner layer 702 and outer layer 704 can rotate with respect to one another.

Figure 9:
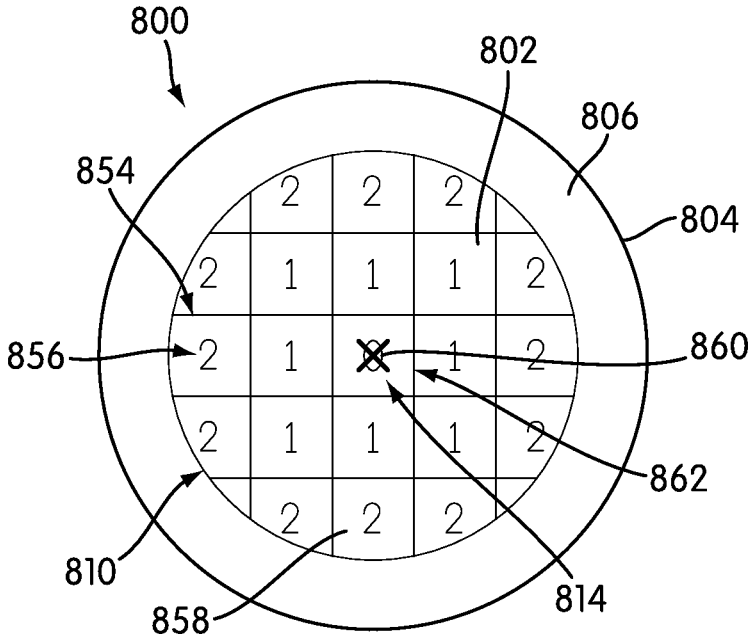
FIG. 9 is a front view of another embodiment of a golf ball.

FIG. 9 shows a side view of an alternative embodiment of a golf ball 800. Golf ball 800 includes an inner layer 802 that has the same characteristics as inner layer 102 and an outer layer 804 that has the same characteristics as outer layer 104. Inner layer 802 and outer layer 804 are spaced from one another, forming cavity 806 that has the same characteristics as cavity 106, including being filled with a similar fluid. Inner layer 802 and outer layer 804 may be capable of rotating independently of one another.

First indicia 810 is applied on inner layer 802 and has the same basic characteristics as first indicia 110. First indicia 810 includes a plurality of grid lines 854 and numbers 856 in squares 858 defined by grid lines 854. Second indicia 814 is applied on outer layer 804 and has the same basic characteristics as second indicia 114. Second indicia 814 may comprise an X shape 860.

It may be desirable to use a numbered grid when it is desired, for example, to consider shear force applied along various axes or planes. In the embodiment shown in FIG. 9, outer layer 804 can be positioned so that second indicia 814 is positioned in a designated first indicia starting grid square, such as the starting square 862 marked with a 0. When the outer layer 804 moves with respect to inner layer 802, a user can determine the directionality and magnitude of the force depending on the final position of outer layer 804 relative to inner layer 802.

Figure 10:
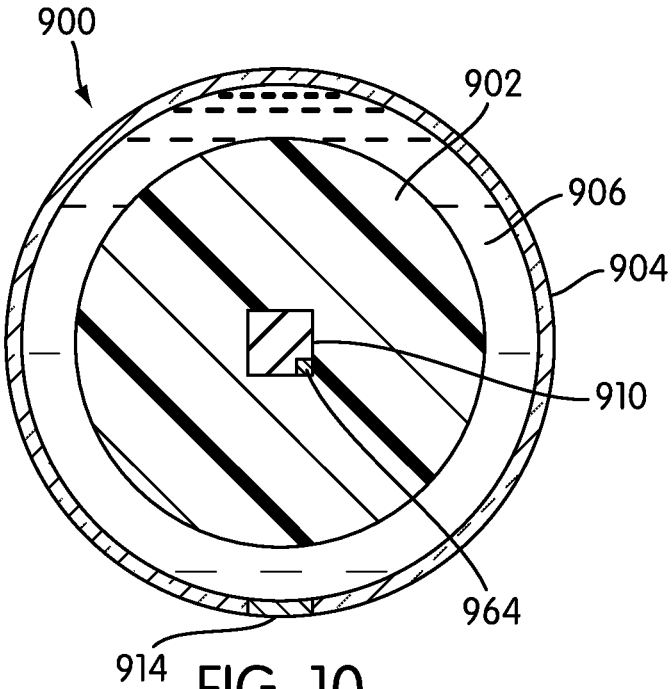
FIG. 10 is a cross section of another embodiment of a golf ball.

FIG. 10 shows a sectional view of an alternative embodiment of a golf ball 900. Golf ball 900 includes an inner layer 902 that has the same characteristics as inner layer 102 and an outer layer 904 that has the same characteristics as outer layer 104. Inner layer 902 and outer layer 904 are spaced from one another, forming cavity 906 that has the same characteristics as cavity 106, including being filled with a similar fluid. Inner layer 902 and outer layer 904 may be capable of rotating independently of one another.

First indicia 910 may be applied on inner layer 902 by being embedded within the core or within inner layer 902. Second indicia 914 may be applied on outer layer 904 by being embedded within outer layer 904. While first indicia 910 is sown as being embedded in the center of inner layer 902, first indicia 910 may be applied on the outside of inner layer 902 or at any position in or on inner layer 902 and be considered positioned in inner layer 902. First indicia 910 and second indicia 914 may be selected so that they are compatible with one another. For example, second indicia 914 may be a magnet or other item that works as a sensor trigger and first indicia 910 may be a sensor capable of sensing the number, speed or other rotation characteristics of how second indicia 914 rotates around first indicia 910. The sensor may also be capable of sensing the number, speed or other rotation characteristics of how inner layer 902 rotates. First indicia 910 may be piezo electric, so that it can actuate upon impact by a golf club or may have a long life battery to allow first indicia 910 to perform its sensing function. In addition first indicia 910 may include transceiver 964 to allow first indicia to receive or transmit instructions or data.

Figure 11:
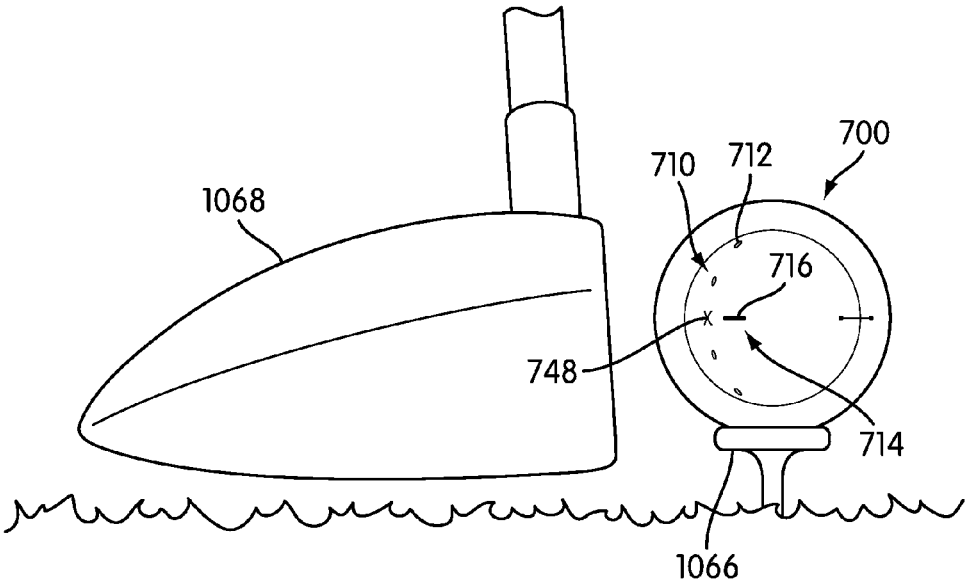
FIG. 11 is a view showing one embodiment of a golf ball before being struck by a golf club.
Figure 12:
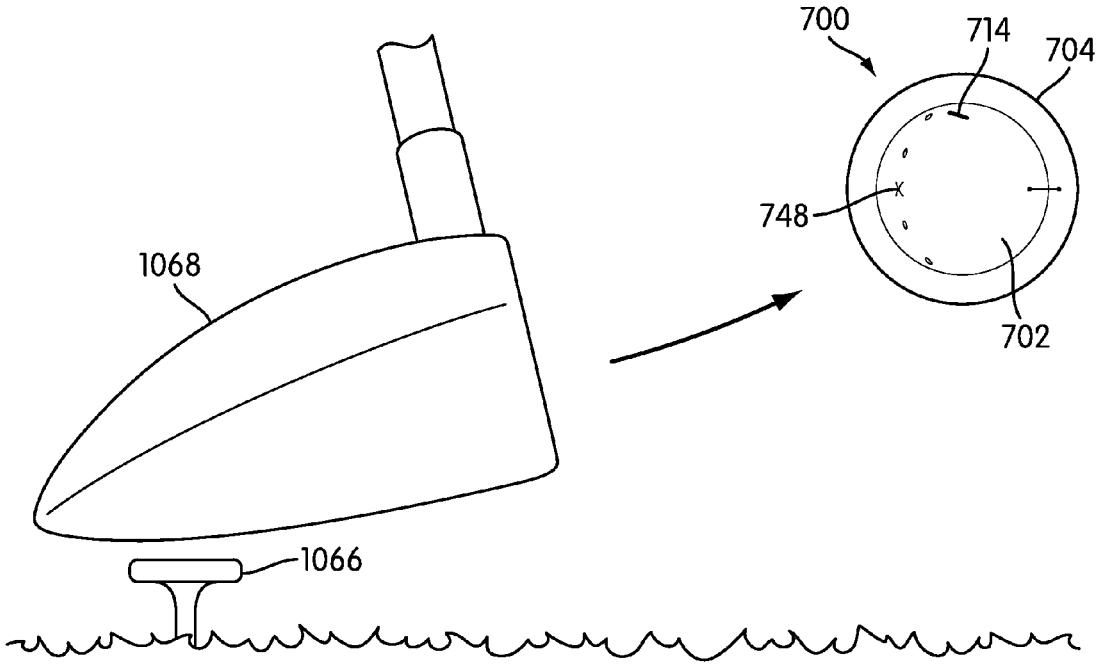
FIG. 12 is a view of the golf ball and club of FIG. 11 after the ball is struck by the club.
Figure 13:
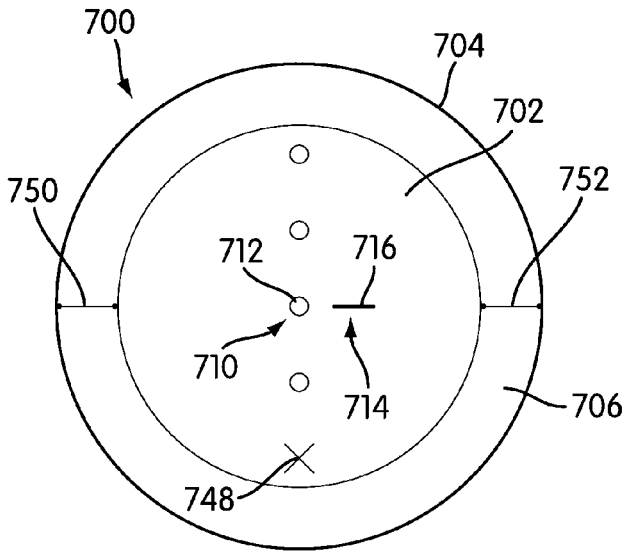
FIG. 13 is a front view of the golf ball of FIG. 11 after the ball has come to rest.

FIGS. 11-13 show a method of use for the golf balls and alternatives disclosed herein. FIGS. 11-13 show the use of golf ball 700 as shown in FIG. 8. The method is described in conjunction with that embodiment. However, any of the ball embodiments can be used in the method described.

As shown in FIG. 11, ball 700 may be positioned on a tee 1066. Ball 700 may alternatively be placed on the ground, on a tether, or otherwise positioned as may be desired by a user. As shown in FIG. 11, first indicia 710 includes plurality of dots 712 and alignment marking 748. Second indicia 714 includes a line 716 that is aligned with alignment marking 748. A first relative position of first indicia 710 and second indicia 714, such as the aligned position shown, may be selected for use as a starting position or for use at a first specified time. Ball 700 is then ready to be struck by club 1068. FIG. 11 shows the use of a driver or other wood as club 1068. Any club can be selected instead of the driver shown as may be desired by a user or for any other reason.

As shown in FIG. 12, when club 1068 strikes ball 700, inner layer 702 and outer layer 704 rotate independently of one another. As may be seen, second indicia 714 has rotated to a position away from first indicia alignment indicia 748. FIG. 12 is shown for illustrative purposes, and it is unlikely that any relative position of inner layer 702 and outer layer 704 will be examined or determined while ball 700 is in the air.

FIG. 13 shows a potential final rest position of ball 700. When ball reaches its final rest position or another designated position at a second specified time, ball 700 can be examined to determine the final or second relative position of first indicia 710 and second indicia 714. FIG. 13 shows one exemplary version of a second relative position. FIG. 13 shows that second indicia 714 is positioned generally adjacent the first indicia second dot 712 above first indicia alignment indicia 748. The use of a guide, such as first spindle 750 and second spindle 752, restricts rotation of outer layer 704 relative to inner layer 702 to one axis and may enable a less complicated analysis of the shear force applied to ball 700 upon impact by club 1068, as first indicia 710 and second indicia 714 will maintain a predictable range of relative positions.

Once the first relative position at a first specified time before being struck by the club and the second relative position at a second specified time after being struck by the club have been determined, the first relative position and the second relative position data can be used. The first relative position and the second relative position can be compared to one another. The first relative position and the second relative position can be compared with a database that indicates a particular shear force that yields the two relative positions. The database can take the form of a printed chart or other comparison data printed on paper. Alternative, the database can take the form of a database within a computer.

If the database is a database in a computer, data relating to the first relative position and the second relative position may also be input into the computer to allow or improve the calculation of shear force applied to the ball. The computer can be configured like computer 1170 shown in FIG. 14. The step of inputting data may take the form of inputting by image acquisition system 1172, such as a scanner or camera functionally attached to the computer that allows input of optical data directly to the computer. Alternatively, the step of inputting data may take the form of a user inputting information about the first and second relative positions through data input system 1174, such as a mouse, keyboard, stylus, or other relevant input system. Software on computer 1170, in attached data storage 1176, or accessible via the internet 1178 may instruct the user on how to select the first relative position, how to input data relating to the first relative position and the second relative position, and any other relevant data, such as the time or distance the ball is in the air, atmospheric conditions, or any other relevant data.

The methods disclosed herein may include striking the ball and collecting the ball from a golf course. Alternatively, the method could be performed in an indoor or outdoor venue that allows the ball to be hit into a net or other barrier in order to limit the time and distance the ball carries in order to limit relative rotation of the inner and outer layers and simplify the calculation of shear force applied.

Figure 14:
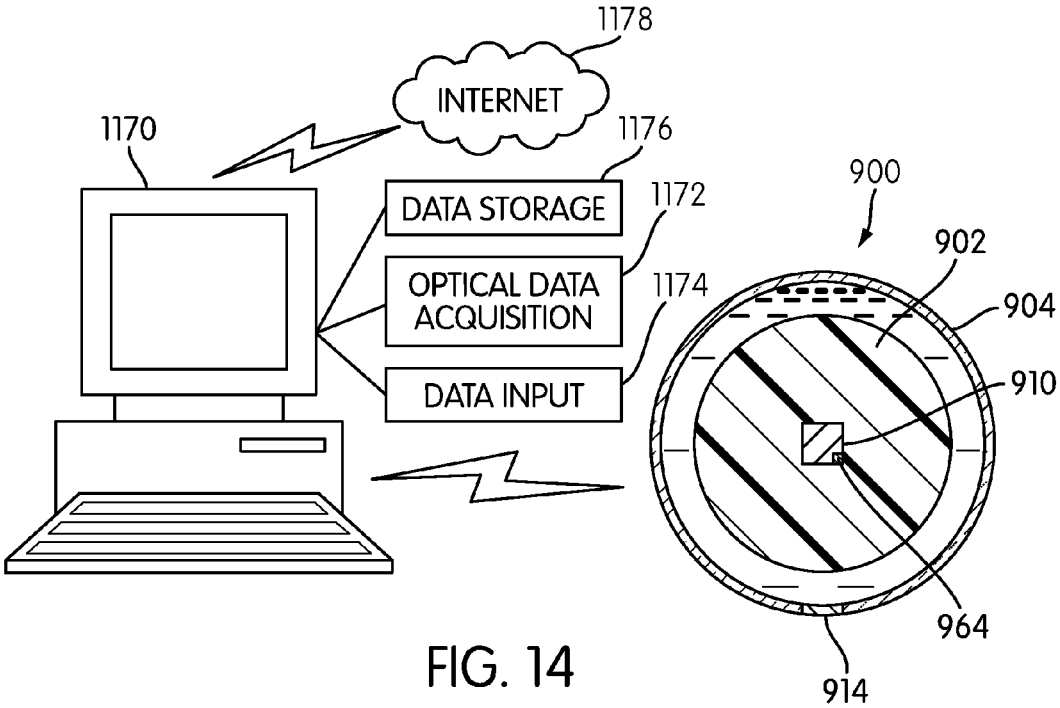
FIG. 14 is a view showing the association of the embodiment of FIG. 10 with a computer.

An alternative method is shown in FIG. 14. The method shown in FIG. 14 is most easily used with a ball such as that shown in FIG. 10, and ball 900 of FIG. 10 is illustrated therein.

As noted in the discussion of ball 900 in FIG. 10, sensor 910 is positioned in inner layer 902. Sensor trigger 914 is embedded in outer layer 904. Inner layer 902 and outer layer 904 are capable of rotating independently of one another. Ball 900 is struck by a club, such as was described in FIGS. 11 and 12. When ball 900 is struck, sensor 910 actuates and senses the movement of inner layer 902 and the relative movement of sensor trigger 914. Sensor 910 may, for example, consider the number of rotations of inner layer 902 and the number of rotations of outer layer 904. The data determined by sensor 910 can then be acquired and evaluated to determine the shear force applied to ball 900 when struck by club 1068.

As shown in FIG. 14, the step of acquiring the data from sensor 910 can be performed by associating ball 900 with computer 1170. As shown in FIG. 14, associating ball 900 with computer 1170 may be as simple as moving ball 900 close to computer 1170. Computer 1170 may be equipped with any available hardware or software that triggers transceiver 964 on sensor 910 to transmit the acquired data to computer 1170. The data transmission can use any wired or wireless transmission system, for example including Bluetooth or infrared transmission.

Once the acquired data from ball 900 is transmitted to computer 1170, the data can be used to calculate the shear force from the stroke. The acquired data can be compared to a database stored in or accessible to computer 1170, either by accessing the internet 1178 or an attached data storage 1176, such as a hard or floppy drive, or other external drive or data storage attached to computer via wired or wireless connection. The database can be used to calculate the shear force from the golf stroke, the swing profile of the user who struck the ball, or any other calculations reasonably available from the relative movement of the inner and outer layers after being struck by the club.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of determining a shear force imparted to a golf ball when struck with a golf club, comprising:

providing first indicia on an inner layer of the ball;

providing second indicia on an outer layer of the ball;

providing a fluid in a cavity between the inner layer and the outer layer;

determining a first relative position of the first indicia and the second indicia at a first specified time;

determining a second relative position of the first indicia and the second indicia at a second specified time, the golf ball having been struck with a golf club between the first specified time and the second specified time to impart a shear force to the golf ball;

comparing a difference between the first relative position and the second relative position; and determining the shear force imparted to the golf ball based on the difference between the first relative position and the second relative position.

2. The method of determining a shear force according to claim 1, further comprising comparing the relative position of the first indicia and the second indicia with a database.

3. The method of determining a shear force according to claim 1, further comprising inputting data relating to the relative position into a computer.

4. The method of determining a shear force according to claim 1, further comprising rotating at least one of the inner layer and the outer layer to place the first indicia and the second indicia in the first relative position.

5. The method of determining a shear force according to claim 4, wherein the first indicia includes an alignment aid and the second indicia comprises a line, the method further comprising aligning the line with the alignment aid in the first relative position.

6. The method of determining a shear force according to claim 1, further comprising allowing the inner layer to rotate independently of the outer layer.

7. The method of determining a shear force according to claim 6, further comprising restricting relative rotation between the first layer and the second layer to one axis.

* * * * *